US005584535A

United States Patent [19]

Jacobson et al.

[11] Patent Number: 5,584,535

[45] Date of Patent: Dec. 17, 1996

[54] EASILY ADJUSTABLE FOOTREST

[75] Inventors: Jason R. Jacobson, St. Paul; Kenneth J. Kirchhoff, Gem Lake, both of Minn.

[73] Assignee: Minnesota Mining and Manufacturing Company, St. Paul, Minn.

[21] Appl. No.: 423,651

[22] Filed: Apr. 17, 1995

[51] Int. Cl.[6] ..... A47C 16/02

[52] U.S. Cl. ..... 297/423.46; 297/423.39; 297/423.41; 297/423.44; 297/423.45; 248/346.06; 248/371; 248/423

[58] Field of Search ..... 297/423.46, 423.45, 297/423.44, 423.41, 423.39; 248/371, 346.06, 423

[56] References Cited

U.S. PATENT DOCUMENTS

| | | |
|---|---|---|
| 269,780 | 12/1882 | Fenny . |
| 2,850,081 | 9/1958 | Dillon . |
| 2,912,046 | 11/1959 | Fuerst . |
| 3,653,715 | 4/1972 | Drabert et al. . |
| 3,940,181 | 2/1976 | Cheek, Jr. . |
| 4,310,193 | 1/1982 | Kolleas . |
| 4,946,120 | 8/1990 | Hatcher . |
| 5,340,076 | 8/1994 | Dockwiller, III . |
| 5,419,618 | 5/1995 | Hatcher . |

FOREIGN PATENT DOCUMENTS

| | | |
|---|---|---|
| 961286 | 6/1964 | United Kingdom . |

*Primary Examiner*—Jose V. Chen
*Assistant Examiner*—Rodney B. White
*Attorney, Agent, or Firm*—Gary L. Griswold; Walter N. Kirn; William L. Huebsch

[57] ABSTRACT

A footrest to be supported on a floor for which the height of the footrest from the floor and the angle of a foot support surface on the footrest with respect to the floor are independently adjustable. Projections on one portion of the footrest are movable in slots in another between spaced retaining portions in which the projections are frictionally retained to change the height of the footrest; and a platform defining the foot support surface is pivotable against the restraint of a friction clutch to change its angle with respect to the floor.

6 Claims, 6 Drawing Sheets

EASILY ADJUSTABLE FOOTREST

TECHNICAL FIELD

The present invention relates generally to footrests.

BACKGROUND ART

The art is replete with descriptions of footrests and similar devices. Illustrative examples include U.S. Pat. Nos. 269,780; 815,046; 1,217,246; 2,248,369; 2,850,081; 2,912,046; 3,121,551; 3,271,075; 3,653,715; 4,296,694; 4,310,193; 4,901,385; 5,294,180; 5,316,374; and 5,348,377; British patent documents 961,286 and 2,153,217; Swiss patent documents 386,640 and 675,347; German patent document 1,193,215; and Misco Fall 1993 Computer Products Catalog, page 125.

U.S. patent application Ser. No. 08/142,582, filed Oct. 25, 1993, describes a footrest for use by a person working at a desk that has a base supporting above the floor a platform with a foot support surface for a user's feet. The platform is mounted on the base so that the height of the platform above the floor and the angle at which the foot support surface is disposed with respect to the floor are independently adjustable. Generally, the footrest described in that application included (1) the base that included means for defining a supported surface adapted to be supported on a floor, and spaced support portions projecting generally at fight angles away from that supported surface; (2) the platform that included a foot support portion having the foot support surface, and a pair of spaced supported portions projecting from the side of the foot support portion opposite the foot support surface; (3) a pair of intermediate support members; (4) pivotable means mounting a part of each of the supported portions of the platform on a part of a different one of the intermediate support members adjacent a first edge for pivotal movement of the platform around an axis parallel with the supported surface; and (5) adjustable means mounting a portion of each of the intermediate support members adjacent an opposite second edge thereof in fixed relationship on a different one of the spaced support portions of the base and affording adjustment of both of the attached portions between a first relative position with the axis spaced a first distance from the supported surface, and a second relative position with the axis spaced a second position from the supported surface.

In that footrest, however, the adjustable means was provided by rows of apertures in the intermediate support members and in the support portions, different pairs of which apertures could be aligned to position the axis about which platform pivots at different distances from the supported surface on the base, after which fasteners could be inserted through aligned pairs of apertures and tightened to secure the intermediate support members to the base at the desired positions. Changing the distance between the axis and the supported surface required removal of the fasteners from the apertures and their subsequent replacement, which was time consuming and risked the loss of parts of the fasteners.

Also in that footrest the angular relationship between the foot rest surface and the supported surface on the base was selected from several predetermined angular relationships that also required the use of fasteners generally in the manner described above and might not include the angular relationship that a specific user desired.

DISLOCATE OF THE INVENTION

The present invention provides a footrest generally of the type described above that affords easy height adjustability without the necessity of removing and replacing fasteners; and which allows a user to select any desired angular relationship in a predetermined range between the foot support surface and a supported surface on the base, which selection can be made while the footrest is in use.

Generally the footrest according to the present invention comprises (1) a base including means for defining a supported surface adapted to be supported on a floor, and spaced support portions projecting generally at fight angles away from the supported surface; (2) a platform including a foot support portion having a foot support surface adapted for receiving a person's feet, and a pair of spaced supported portions projecting from the side of the foot support portion opposite the foot support surface; (3) a pair of intermediate support members each having opposite first and second edges; (4) pivotable means mounting a part of each of the supported portions of the platform on a part of a different one of the intermediate support members adjacent its first edge for pivotal movement of the platform around an axis parallel with the supported surface; and (5) adjustable means mounting portions of each of the intermediate support members adjacent its second edge in fixed relationship on a different one of the spaced support portions of the base to provide pairs of attached portions and for affording adjustment of the attached portions between a first relative position with the axis spaced a first distance from the supported surface, and a second relative position with the axis spaced a second position from the supported surface. That adjustable means is provided in that for each of the pairs of attached portions, one of the portions has a projection projecting generally parallel to the supported surface, and the other of the portions has surfaces defining a slot receiving the projection. The slot includes a transfer portion extending generally at a fight angle to the supported surface, and spaced retaining portions each having an inlet end communicating with the transfer portion and a closed end. The retaining portions of the slot from their inlet to their closed ends each are oriented to cause, when the projection is in the retaining portion, the weight of the platform and the intermediate support portions to bias the projection toward the closed end of the slot. The projections on the portions are movable along the transfer portions of the slots between their spaced retaining portions to afford adjustment the attached portions between their first and second relative positions.

The slots can be in the spaced support portions of the base and the projections can be on the intermediate support members, in which case the retaining portions of the slots each extend toward the supported surface of the base from their inlet to their closed ends.

Alternatively, the slots can be in the intermediate support members and the projections can be on the spaced support portions of the base, in which case the retaining portions of the slots each extend away from the supported surface of the base from their inlet toward their closed ends.

The surfaces defining the retaining portions of the slots can be tapered from their inlet ends to their closed ends such that they will frictionally engage the opposite sides of the projections adjacent their closed ends to help hold the projections therein against inadvertent forces tending to displace them, such as may be experienced when the foot rest is moved from place to place.

Also, for each of the pairs of attached portions the portion from which the projection projects can have a through opening, and the projection can comprise a bolt extending through that opening and the slot, and releasable means comprising that bolt can be provided for forcefully pressing the pair of attachment portions together in a direction parallel to the supported surface to further retain the projections or bolts in desired retaining portions of the slots.

Preferably, the pivotable means mounting a part of each of the supported portions of the platform on a part of a different one of the intermediate support members for pivotal movement of the platform around an axis parallel with the supported surface comprises (1) a bolt extending through the intermediate support member and the supported portion with the axis of the bolt parallel with the supported surface, (2) a friction washer through which the bolt extends positioned between the intermediate support member and the supported portion, and (3) adjustable means comprising the bolt for pressing the support member and the supported portion towards opposite sides of the friction washers to restrict pivotal movement of the platform relative to the base while affording such movement in response to application of a sufficient amount of force along the foot support surface by the feet of a person using the footrest.

BRIEF DESCRIPTION OF THE DRAWING

The present invention will be further described with reference to the accompanying drawing wherein like reference numerals refer to like parts in the several views, and wherein:

FIG. 8 is a fragmentary enlarged view of a part of an adjustable means for attaching portions of the footrest together; and.

DETAILED DESCRIPTION OF THE PREFERRED EMBODIMENT

Figure 1:
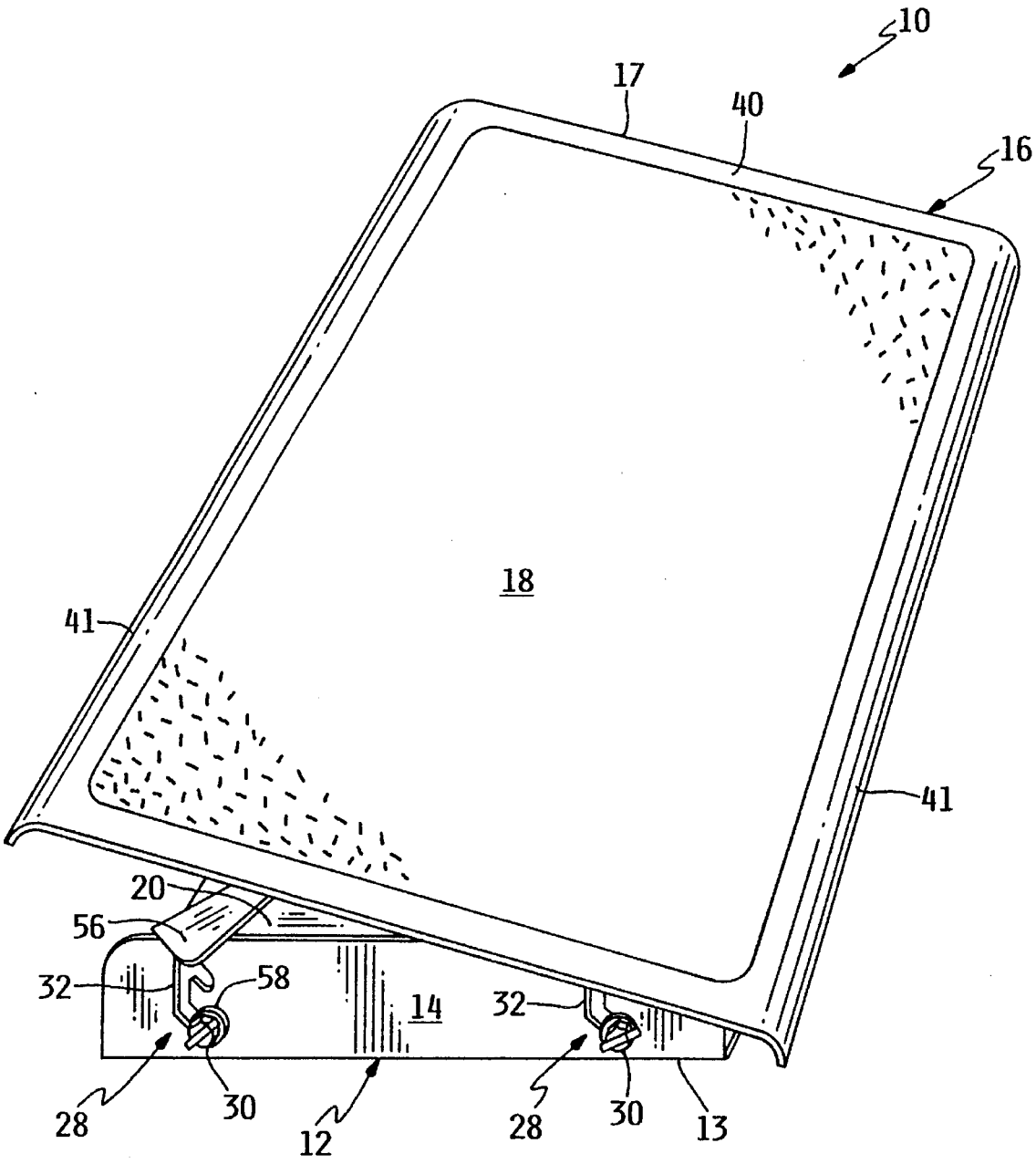
FIG. 1 and 2 are perspective views of a foot rest according to the present invention.
Figure 2:
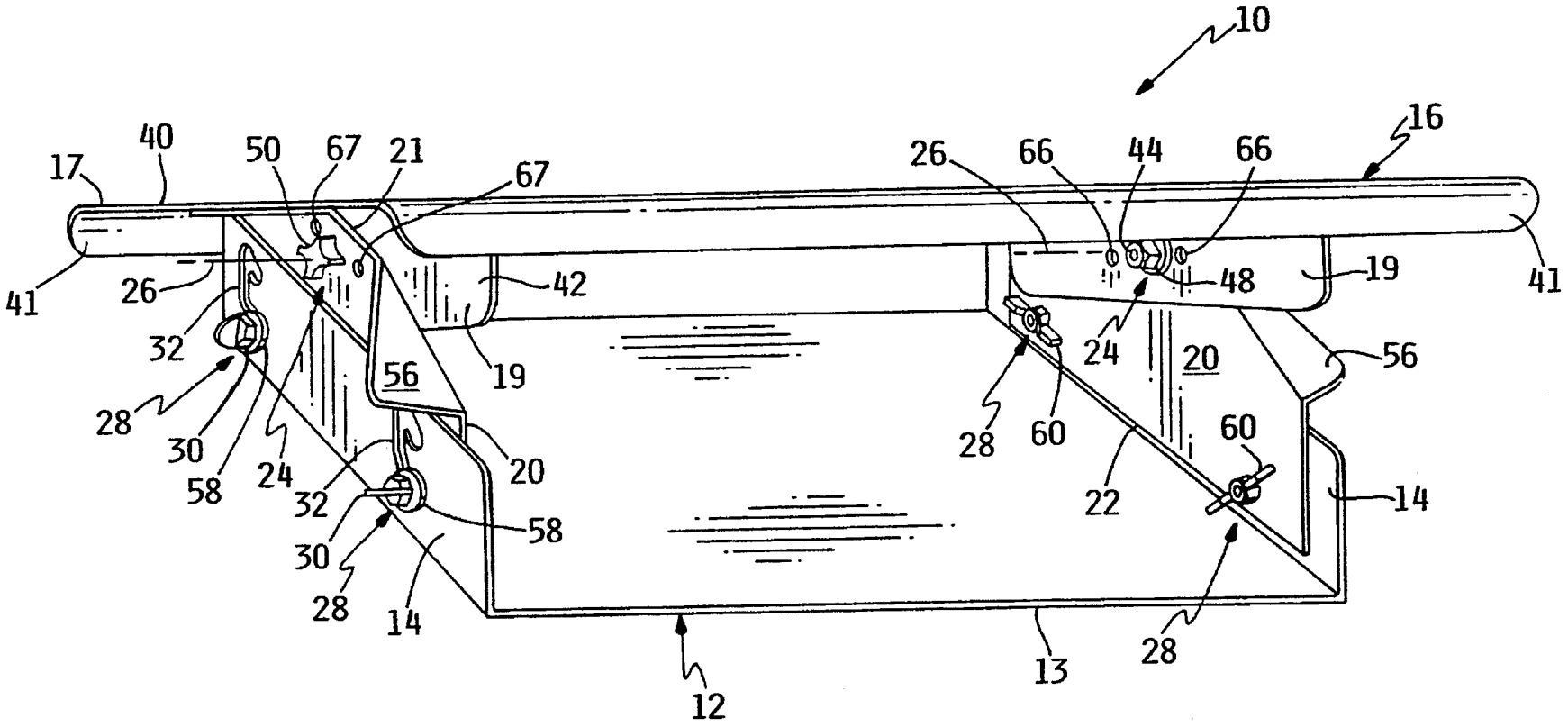
Figure 3:
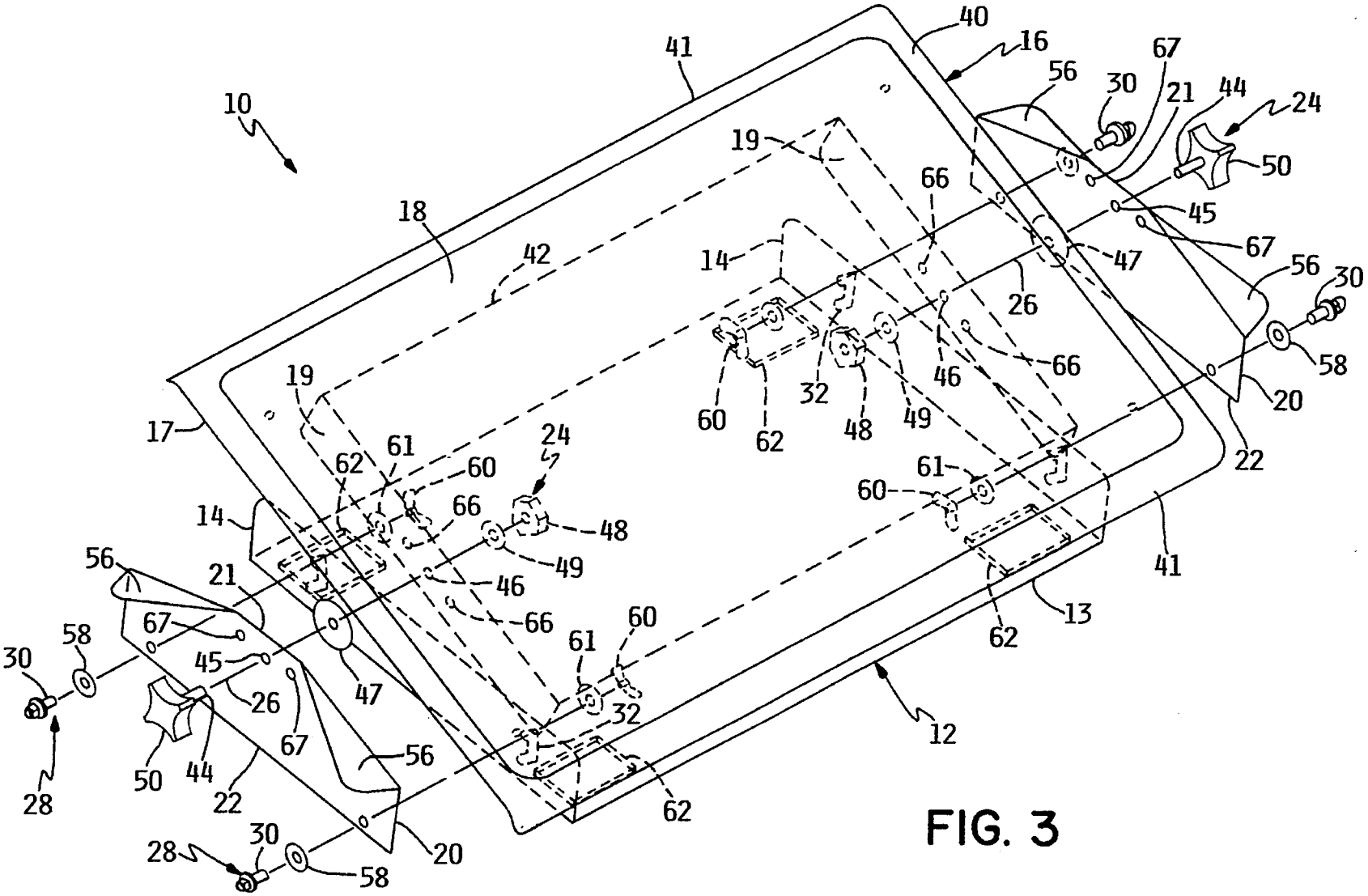
FIG. 3 is an exploded view of the foot rest illustrated in FIGS. 1 and 2
Figure 4:
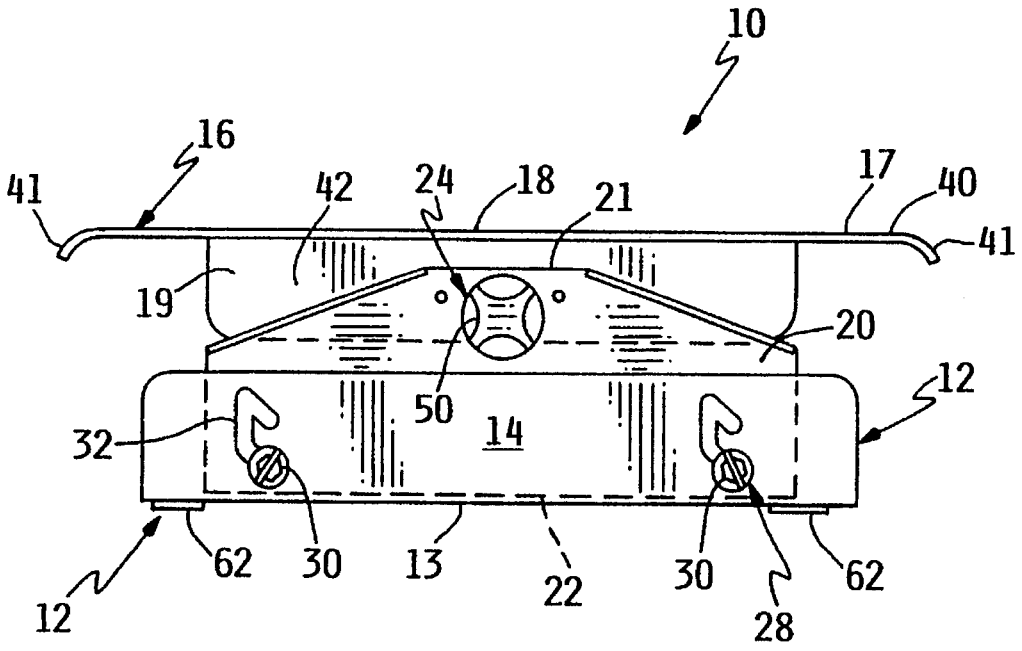
FIG. 4, 5, 6 and 7 are reduced end views of the footrest of FIGS. 1, 2 and 3 illustrating different heights to which the footrest can be adjusted and different angles to which a foot support surface on the footrest can be adjusted.

Referring now to the drawing there is illustrated a footrest according to the present invention generally designated by the reference numeral 10.

Figure 5:
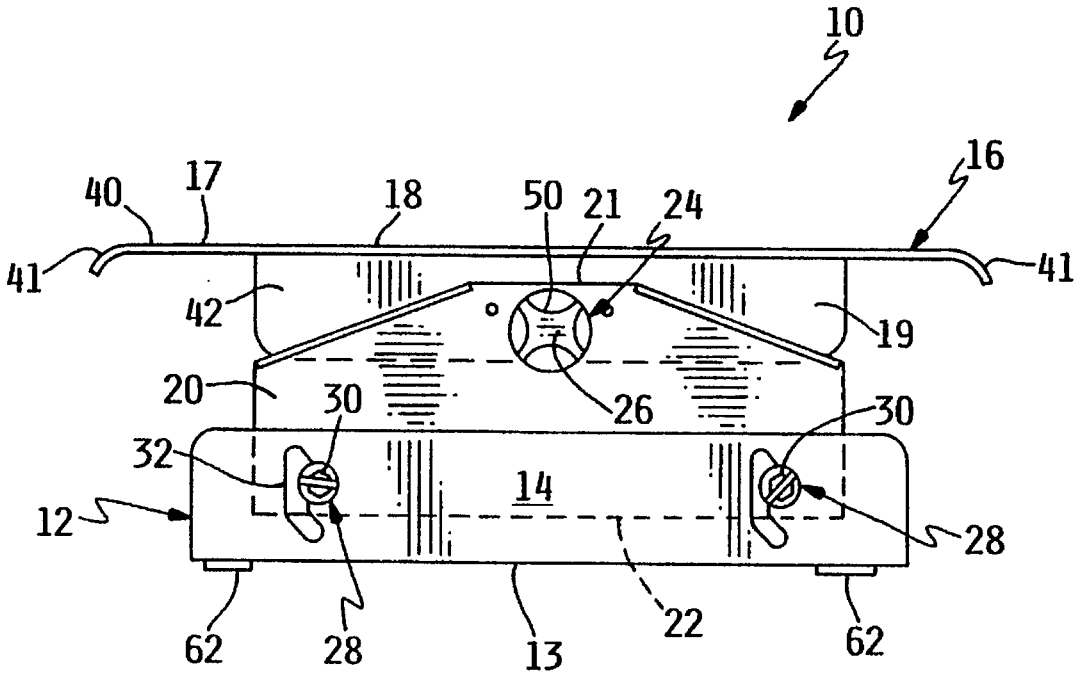
Figure 6:
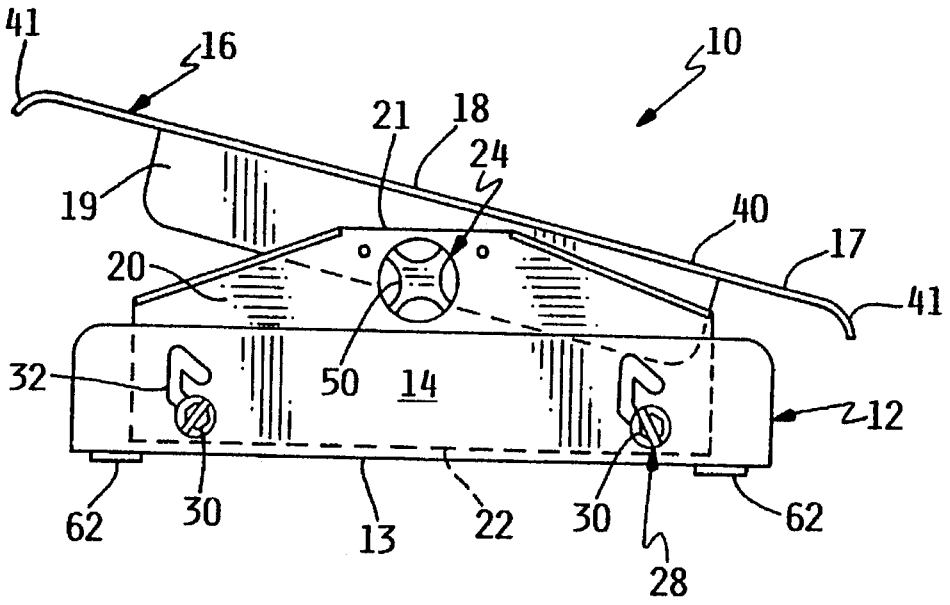
Figure 7:
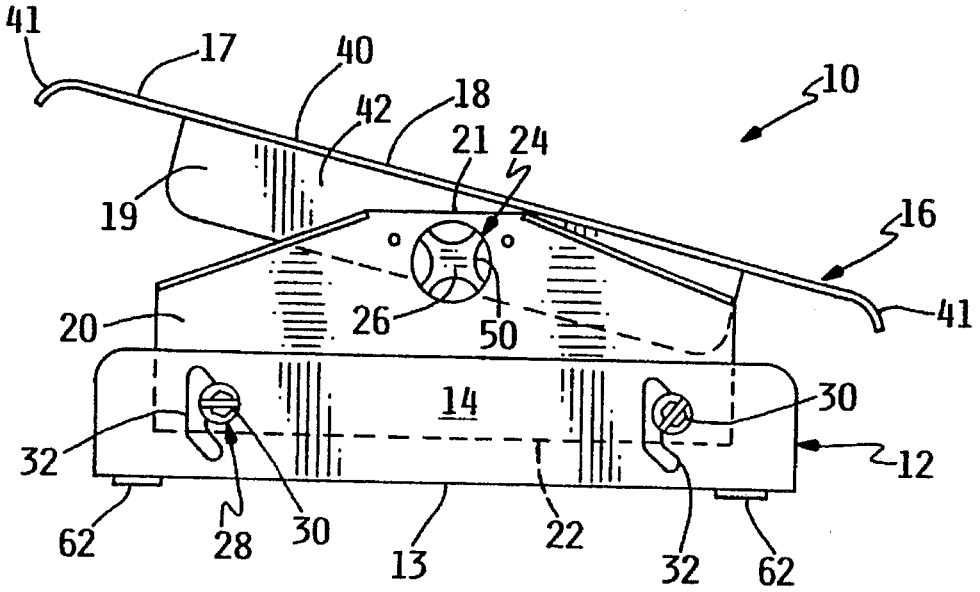
Figure 8:
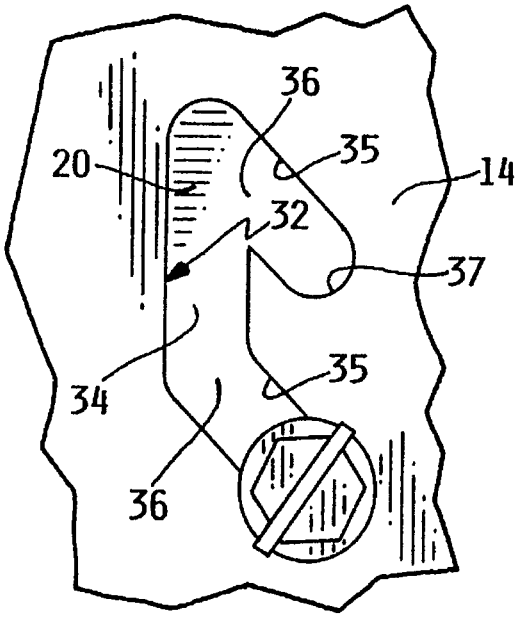

Generally, the footrest 10 comprises (1) a base 12 including means for defining a supported surface 13 adapted to be supported on a floor, and spaced support portions 14 projecting generally at fight angles away from the supported surface 13; (2) a platform 16 including a foot support portion 17 having a foot support surface 18 adapted for receiving a person's feet, and a pair of spaced supported portions 19 projecting generally at fight angles away from the side of the foot support portion 17 opposite its foot support surface 18; (3) a pair of intermediate support members 20 each having opposite first and second edges 21 and 22; (4) pivotable means 24 mounting a part of each of the supported portions 19 of the platform 16 on a part of a different one of the intermediate support members 20 adjacent its first edge 21 for pivotal movement of the platform around an axis 26 parallel with the supported surface 13; and (5) adjustable means 28 mounting portions of each of the intermediate support members 20 adjacent its second edge 22 in fixed relationship on a different one of the spaced support portions 14 of the base 12 to provide pairs of attached portions and for affording adjustment of the attached portions between a first relative position (FIGS. 1, 2, 4, and 6) with the axis 26 spaced a first distance from the supported surface 13, and a second relative position (FIGS. 5 and 7) with the axis 26 spaced a second greater distance from the supported surface 13. For each of the pairs of attached portions, one of the portions has a projection 30 projecting generally parallel to the supported surface 13, and the other of the portions has surfaces defining a through slot 32 through which the projection 30 extends. As is best seen in FIG. 8, each slot 32 includes a transfer portion 34 extending generally at a fight angle to the supported surface 13, and spaced retaining portions 35. Each of the retaining portions 35 of each slot 32 has an inlet end 36 communicating with the transfer portion 34 and an opposite closed end 37. The retaining portions 35 of each slot 32 from its inlet end 36 to its closed end 37 is oriented to cause, when the projection 30 is in the retaining portion 35 and the supported surface 13 is on a floor, the weight of the platform 16 and the intermediate support members 20 to bias the projection 30 toward the closed end 37 of the slot 32. The projections 30 on the portions are movable along the transfer portions 34 of the slots 32 between their spaced retaining portions 35 to afford adjustment of the attached portions between their first and second relative positions.

The foot support portion 17 of the platform 16 comprises a generally flat plate 40 that helps to define the foot support surface 18 and is formed along its forward and rear edges to have downwardly curved edge portions 41. Attached to the side of the plate 40 opposite the foot support surface 18 (i.e., by rivets or otherwise) is a generally U-shaped plate 42 that includes the two spaced supported portions 19.

The intermediate support members 20 include generally flat major portions having the first and second edges 21 and 22 that lie along the outer surfaces of the supported portions 19 and the inner surfaces of the support portions 14.

The pivotable means 24 mounting a part of each of the supported portions 19 of the platform 16 on a part of a different one of the intermediate support members 20 adjacent its first edge 21 for pivotal movement of the platform 16 comprises a bolt 44 (e.g., ¼–20 thread) extending through apertures 45 and 46 respectively in each of the pairs of intermediate support members 20 and supported portions 19 with the axis of the bolt 44 parallel with the supported surface 13, a friction washer 47 (e.g., a 1.25 inch diameter 0.031 inch thick washer 47 of the material commercially designated "Santoprene" available from Climatek, Minneapolis, Minn.) through which the bolt 44 passes positioned between the adjacent pairs of intermediate support members 20 and supported portions 19, and adjustable means provided by the bolt 44, a washer 49, and a nut 48 for pressing the intermediate support members 20 and supported portions 19 towards opposite sides of the friction washers 47 to create friction therebetween. That friction can be adjusted by tightening the bolt 44 relative to the nut 48 to restrict pivotal movement of the platform 16 relative to the base 12 while affording such movement in response to application of a sufficient predetermined amount of such force along the foot support surface 18 by the feet of a person using the foot rest 10. The bolt 44 may have a manually engageable fluted head 50 to facilitate such adjustment, and the nut 48 may be a lock nut with a nylon insert.

The intermediate support members 20 also include generally flat tab portions 56 projecting at right angles to their major portions at opposite ends of their first edges 21 and oriented to be engaged by the adjacent side of the plate 40 to limit the range of angles through which the platform 16 can be pivoted relative to the base 12.

The projections 30 included in the adjustable means 28 may be bolts in the form of thumb screws (e.g., ¼–20 thread) having washers 58 under their heads adapted to slide along the support portions 14. A nut 60, which may be a butterfly wing nut, and a flat washer 61 may be used on each thumb screw 30, and the thumb screw 30 and nut 60 may be manually tightened if desired to press the support portion 14 and intermediate support members 20 together.

Static-dissipating sheet steel can be used to make the base 12 and intermediate support members 20 (e.g., 18 gauge), and the platform 16 (e.g., 16 gauge). Self-adhesive polymeric friction pads 62 may be adhesively attached at the comers of the sheet metal portion of the base 12 to define the supported surface 13 and provide resistance to sliding for the footrest 10 on smooth or carpeted floors. Self-adhesive polymeric strips (not shown) may be adhered to the lower surface of the plate 40 in a position where they will cushion engagement of the platform 16 with the tab portions 56. The foot support surface 18 of the platform 16 may be defined by a sheet 64 of non-slip material adhered to the plate 40 such as, for example, the product marketed by Minnesota Mining and Manufacturing Company of St. Paul, Minn. commercially designated 3M Safety-Walk which provides a nonslip surface that restricts shoes from slipping on it. The finish for the sheet steel parts of the footrest 10 may be a pearl gray epoxy coating for compatibility with office surroundings.

As example, non-limiting dimensions for the foot rest 10, the length of the base 12 between the support portions 14 can be about 16 inches, the width of the base 12 can be about 11.5 inches, and the height of the support portions 14 can be about 2 inches. The plate 40 of the platform 16 can have a width of about 14 inches, and a length of about 22 inches. The distance between the supported portions 19 can be about 7/32 inch less than the distance between the support portions 14, and the length and height of each supported portion 19 can be about 9.5 inches and 1.625 inches respectively. The height of each of the intermediate support members 20 between their first and second edges 21 and 22 can be about 3.5 inches. The widths of the transfer portions 34 and of the slots can be about 0.281 inch. The widths of the retaining portions 35 of the slots 32 can be about 0.281 inch at their inlet ends 36 and the retaining portions 32 can taper smoothly to a width of about 0.244 inch at their closed ends 37 which is suitable to frictionally engage the sides of the projections 30 when, as illustrated, the projections 30 are ¼–20 thumb screws. The retaining portions 35 of the slots 32 can extend at angles with respect to the edges 21 and 22 of about 45 degrees, the closed ends 37 of the retaining portions 35 of the slots 32 may be spaced by about ¾ inch in a direction normal to the supported surface 13 so that when the foot support surface 18 is parallel with the supported surface 13, the distance between the foot support surface 18 and the supported surface 13 can be changed between 4 and 4¾ inches. The tab portions 56 may be shaped to afford pivoting movement of the platform 16 through an angle 92 of about 40 degrees.

The height of the footrest 10 between its supported surface 13 and axis 26 can be adjusted without having to remove the thumbscrews 30 by (if necessary) loosening the wing nuts 60 on the thumb screws 30, sliding the thumb screws 30 out of the retaining portions 35 of the slots 32 which might require impacting the platform 16 to release the thumb screws 30 from frictional engagement with the surfaces defining the retaining portions 35 of the slots 32, moving the thumb screws 30 along the transfer portions 34 of the slots 32 and into the other retaining portions 35 of the slots 32. Once in those retaining portions 35 of the slots 32, the weight of the platform 16 and the intermediate support members 20 will bias the thumb screws 30 toward the closed ends 37 of the slots 32 and into frictional engagement with the surfaces defining it. The thumb screws 30 then may, or may not, be tightened If a user prefers not to tighten the thumb screws 30, he may prefer to substitute lock nuts with nylon inserts for the wing nuts 60.

A user can place the thumb screws 30 at corresponding ends of the intermediate support members 20 in different ones of the retaining portions 35 of the slots 32 to tip the edges 21 and 22 of the intermediate support members 20 with respect to the supported surface 13, and thereby obtain an intermediate adjustment for the height of the footrest 10 and allow the foot support surface 18 to be inclined at a greater angle with respect to the supported surface 13 than when the thumb screws 30 are all in corresponding ones of the retaining portions 35 of the slots 32.

If desired, the platform 16 may be locked at a predetermined angle by aligning pairs of the apertures 66 and 67 in the supported portions 19 and in the intermediate support members 20 respectively and fastening a screw through them.

Figure 9:
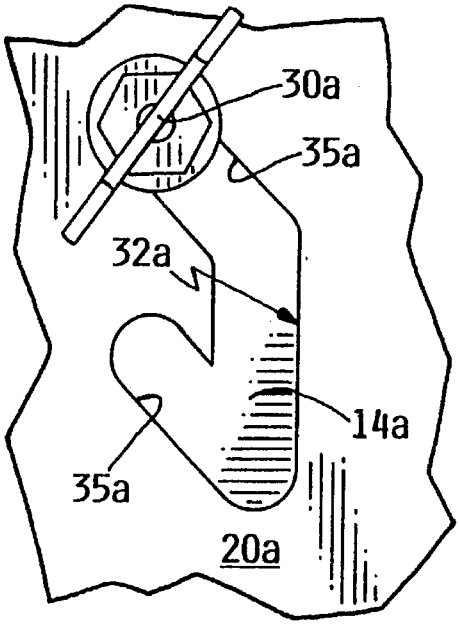
FIG. 9 is a fragmentary enlarged view of a part of an alternative embodiment of an adjustable means for attaching portions of the footrest together.

The present invention has now been described with reference to one embodiment thereof. It will be apparent to those skilled in the art that many changes can be made in the embodiment described without departing from the scope of the present invention. For example, the adjustable means 28 could be changed to the adjustable means **28*a* illustrated in FIG. 9 in which slots 32*a* are formed in the intermediate support members 20*a* instead of in the support portions 14; in which case the projection 30*a* would be mounted on the support portion 14*a* and the retaining portions 35*a* of the slot 32*a*** would project away from the supported surface and toward the platform. Thus, the scope of the present invention should not be limited to the structures and methods described in this application, but only by the structures and method described by the language of the claims and the equivalents thereof.

We claim:

1. A footrest comprising a base including means for defining a supported surface adapted to be supported on a floor, and spaced support portions projecting generally at right angles away from said supported surface;

a platform including a foot support portion having a foot support surface adapted for receiving a person's feet, and a pair of spaced supported portions projecting from a side of said foot support portion opposite said foot support surface;

a pair of intermediate support members each having opposite first and second edges;

pivotable means mounting a part of each of said supported portions of said platform on a part of a different one of said intermediate support members adjacent said first edge for pivotal movement of said platform around an axis parallel with said foot support surface; and adjustable means mounting a portion of each of said intermediate support members adjacent said second edge in fixed relationship on a different one of said spaced support portions of said base to provide pairs of attached portions and for affording adjustment of said attached portions between a first relative position with said axis spaced a first distance from said supported surface, and a second relative position with said axis spaced a second position from said supported surface, for each of said pairs of attached portions, one of said portions having a projection projecting generally parallel to said supported surface, and the other of said portions having surfaces defining a slot receiving said projection, said slot including a transfer portion extending generally at a right angle to said supported surface, and spaced retaining portions, each of said retaining portions of said slot having an inlet end communicating with said transfer portion and a closed end, said retaining portions of said slot from said inlet toward said retaining ends each being oriented to cause, when said projection is in the retaining portion, the weight of said platform and said intermediate support portions to bias the projection toward the closed end of the slot, said projections on said portions being movable along said transfer portions of said slots between said spaced retaining portions of said slot to afford adjustment of said attached portions between said first and second relative positions, said pivotable means mounting a part of each of said supported portions of said platform on a part of a different one of said intermediate support members adjacent said first edge for pivotal movement of said platform around an axis parallel with said supported surface comprises a bolt having an axis extending through each of said pairs of intermediate support members and supported portions with the axis of said bolt parallel with said supported surface, friction washers positioned between said intermediate support members and supported portions, and adjustable means comprising said bolt for pressing said intermediate support members and supported portions towards opposite sides of said friction washers to restrict pivotal movement of said platform relative to said base while affording such movement in response to application of a significant amount of force along said foot support surface by a person's feet.

2. A footrest according to claim 1 wherein said slots are in said spaced support portions of said base, and said retaining portions of said slots each extend toward said supported surface of said base from said inlet end toward said closed end.

3. A footrest according to claim 2 wherein the surfaces defining the retaining portions of said slots are tapered from said inlet ends toward said closed ends of said slots and are adapted to frictionally engage opposite sides of said projections adjacent the closed ends of said slots to help hold the projections therein against inadvertent forces tending to displace them.

4. A footrest according to claim 1 wherein for each of said pairs of attached portions said one portion has a through opening, said projection comprises a bolt extending through said opening and said slot, and said footrest includes releasable means comprising said bolt adapted for forcefully pressing said pair of attachment portions together in a direction parallel to said supported surface.

5. A footrest according to claim 1 wherein said slots are in said intermediate support members, and said retaining portions of said slots each extend away from said supported surface of said base from said inlet end toward said closed end.

6. A footrest comprising a base including means for defining a supported surface adapted to be supported on a floor, and spaced support portions projecting generally at right angles away from said supported surface;

a platform including a foot support portion having a foot support surface adapted for receiving a person's feet, and a pair of spaced supported portions projecting from a side of said foot support portion opposite said foot support surface;

a pair of intermediate support members each having opposite first and second edges;

pivotable means mounting a part of each of said supported portions of said platform on a part of a different one of said intermediate support members adjacent said first edge for pivotal movement of said platform around an axis parallel with said planar surface; and adjustable means mounting a portion of each of said intermediate support members adjacent said second edge in fixed relationship on a different one of said spaced support portions of said base to provide pairs of attached portions and for affording adjustment of said attached portions between a first relative position with said axis spaced a first distance from said supported surface, and a second relative position with said axis spaced a second position from said supported surface;

said pivotable means mounting a part of each of said supported portions of said platform on a part of a different one of said intermediate support members adjacent said first edge for pivotal movement of said platform around an axis parallel with said supported surface comprises a bolt having an axis extending through each of said pairs of intermediate support members and supported portions with the axis of said bolt parallel with said supported surface, friction washers positioned between said intermediate support members and supported portions, and adjustable means comprising said bolt for pressing said intermediate support members and supported portions towards opposite sides of said friction washers to restrict pivotal movement of said platform relative to said base while affording such movement in response to application of a significant amount of force along said foot support surface by a person's feet.

* * * * *